US009638459B2

(12) United States Patent
Choi et al.

(10) Patent No.: US 9,638,459 B2
(45) Date of Patent: May 2, 2017

(54) REFRIGERATOR

(71) Applicant: LG ELECTRONICS INC., Seoul (KR)

(72) Inventors: Daejin Choi, Seoul (KR); Youngkwen Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/002,143

(22) Filed: Jan. 20, 2016

(65) Prior Publication Data

US 2016/0209107 A1 Jul. 21, 2016

(30) Foreign Application Priority Data

Jan. 21, 2015 (KR) ..... 10-2015-0009962

(51) Int. Cl.
*F25D 25/00* (2006.01)
*F25D 25/02* (2006.01)

(52) U.S. Cl.
CPC ..... *F25D 25/025* (2013.01); *A47B 2210/17* (2013.01)

(58) Field of Classification Search
CPC .. F25D 25/025; F25D 23/028; F25D 2323/02; A47B 2210/175; A47B 2210/17
See application file for complete search history.

(56) References Cited

U.S. PATENT DOCUMENTS

| | | | | |
|---|---|---|---|---|
| 6,565,169 | B1 * | 5/2003 | Moreno-Olguin | A47B 88/02 312/270.3 |
| 2007/0018548 | A1 * | 1/2007 | Ertz | A47B 88/02 312/402 |
| 2007/0035221 | A1 * | 2/2007 | Koo | F25D 25/025 312/404 |
| 2010/0090574 | A1 * | 4/2010 | Lim | F25D 25/025 312/404 |
| 2012/0181910 | A1 * | 7/2012 | Kim | F25D 23/02 312/404 |
| 2013/0221824 | A1 * | 8/2013 | Jeon | F25D 23/00 312/404 |
| 2014/0130537 | A1 * | 5/2014 | Gu | F25C 1/04 62/344 |
| 2016/0153704 | A1 * | 6/2016 | Burke | F25D 23/00 312/404 |
| 2016/0178274 | A1 * | 6/2016 | Shin | F25D 25/025 312/408 |

FOREIGN PATENT DOCUMENTS

| | | |
|---|---|---|
| EP | 0 718 571 | 6/1996 |
| JP | 2001-349130 A | 12/2001 |
| KR | 10-2003-0079522 A | 10/2003 |
| KR | 10-2014-0074520 | 6/2014 |

* cited by examiner

*Primary Examiner* — Daniel Rohrhoff
(74) *Attorney, Agent, or Firm* — Ked & Associates LLP

(57) ABSTRACT

A refrigerator includes a cabinet provided with a storage compartment, a lower drawer provided in the cabinet and connected to the door, an upper drawer provided in the cabinet, and positioned over the lower drawer, and an intermediate drawer positioned between the upper drawer and the lower drawer. The lower drawer includes a first stopper. The intermediate drawer includes an actuator movable forwards by the first stopper of the lower drawer when the door is opened, to move the upper drawer.

11 Claims, 9 Drawing Sheets

REFRIGERATOR

Pursuant to 35 U.S.C. §119(a), this application claims the benefit of Korean Patent Application No. 10-2015-0009962, filed on Jan. 21, 2015, which is hereby incorporated by reference as if fully set forth herein.

BACKGROUND

Field

A refrigerator, and more particularly a drawer equipped in a refrigerator is disclosed herein.

Background

Generally, a refrigerator may be an appliance for storing articles in a storage compartment at a lower temperature than normal temperature by supplying cold air generated through a refrigeration cycle. The storage compartment, which may be defined in such a refrigerator, may be include a freezing compartment maintained at a temperature equal to or lower than 0° C., and a refrigerating compartment maintained at a higher temperature than the freezing compartment.

There are refrigerators of various types. For example, a top-freezer type refrigerator includes a freezing compartment arranged at a top side, and a bottom-freezer type refrigerator includes a freezing compartment arranged at a bottom side. Further, a side-by-side type refrigerator may include freezing and refrigerating compartments laterally arranged, and a French-door refrigerator may include a freezing compartment of a drawer type door at a lower portion thereof.

A French-door refrigerator in which a plurality of drawers is installed inside of a single drawer type door in order to allow a user to store various articles in the drawers in accordance with the kinds of the articles has recently been developed. However, this refrigerator may have a problem in that the user cannot view an uppermost one of the drawers while standing when opening the drawer type door and may assume that the uppermost drawer does not exist.

BRIEF DESCRIPTION OF THE DRAWINGS

Embodiments will be described in detail with reference to the following drawings in which like reference numerals refer to like elements, and wherein.

DETAILED DESCRIPTION

Figure 1:
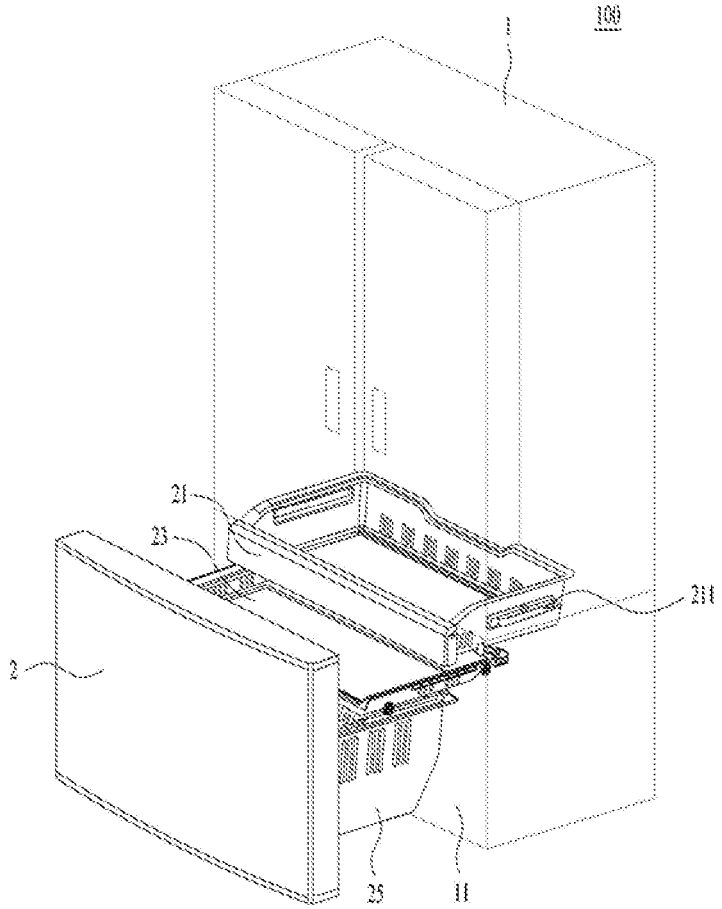
FIG. 1 is a perspective view of a refrigerator according to an embodiment.

As illustrated in FIG. 1, the refrigerator 100 according to the illustrated embodiment may include a cabinet 1 provided with a storage compartment 11, and a door 2 that opens or closes the storage compartment 11. The cabinet 1 may define an appearance of the refrigerator 100. The storage compartment 11 defined in the cabinet 1 may be used as a refrigerating compartment or a freezing compartment in accordance with a set temperature.

The door 2 may be of a drawer type, and may be movable in forward and rearward directions in order to open or close the storage compartment 11. The refrigerator 100 illustrated in FIG. 1 may be of a bottom-freezer type in which a freezing compartment may be arranged at a bottom side. Of course, embodiments may not be limited to the above-described type, and may also be applicable to the case in which the door 2 is arranged at a top side.

In accordance with the illustrated embodiment, a plurality of drawers may be installed inside of the storage compartment 11, which may be opened by the door 2 when the door 2 is opened forwards. The drawers may include a lower drawer 25 mounted to the door 2, an upper drawer 21 mounted to the cabinet 1, and an intermediate door 23 arranged between the upper drawer 21 and the lower drawer 25. When the user opens the door 2, the lower drawer 25 may be moved together with the door 2. The intermediate drawer 23 may also be moved together with the lower drawer 25 while being guided along an upper surface of the lower drawer 25.

The upper drawer 21 may be configured such that movement of the upper drawer may be guided by separate rails. For this reason, there may be a problem in that a user cannot view the upper drawer 21 while standing even when the door 2 is completely opened and, as such, may assume that the upper drawer 21 does not exist or ignores to look at the upper drawer 21.

In accordance with the illustrated embodiment, the intermediate drawer 23 may strike the upper drawer 21 while moving, thereby causing the upper drawer 21 to move forward, and the user may recognize the upper drawer 21 and easily withdraw the upper drawer 21. When the door 2 is opened by the user, the lower drawer 25 may be moved by the door 2, the intermediate drawer 23 may be moved by the lower drawer 25, and the upper drawer 21 may be moved by the intermediate drawer 23. The door 2, lower drawer 25, intermediate drawer 23, and upper drawer 21 may be sequentially moved in the forward direction. Accordingly, the user may simultaneously view all articles stored in the drawers and, as such, convenience may be enhanced.

Figure 2:
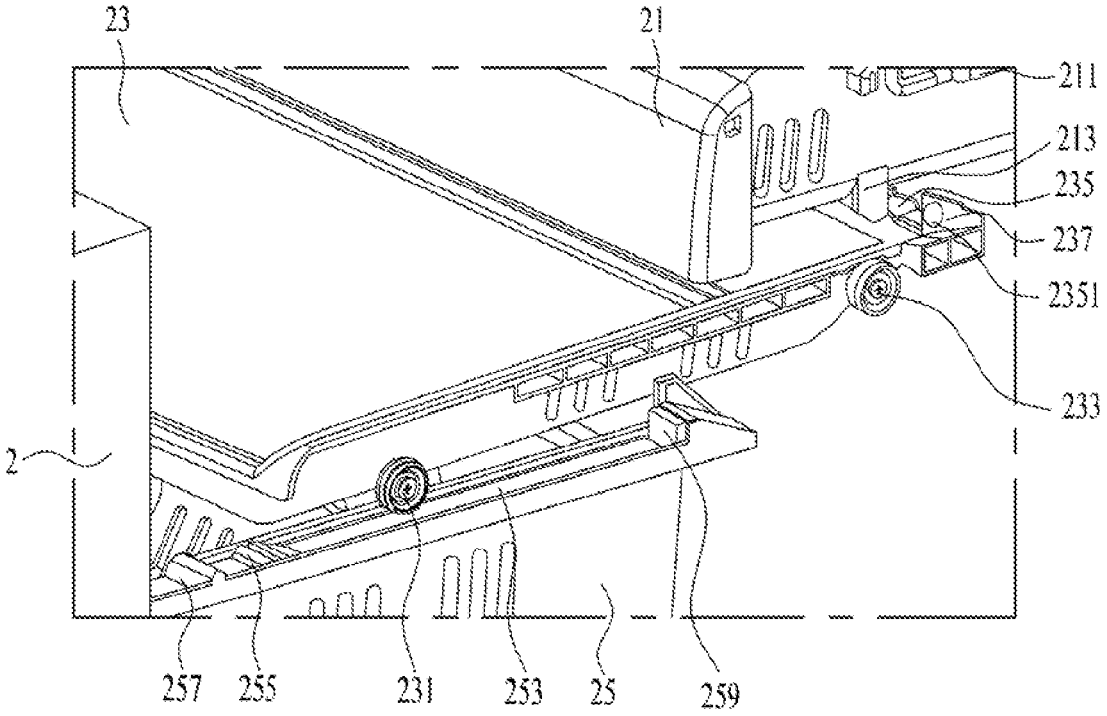
FIG. 2 is an enlarged perspective view corresponding to FIG. 1.
Figure 6:
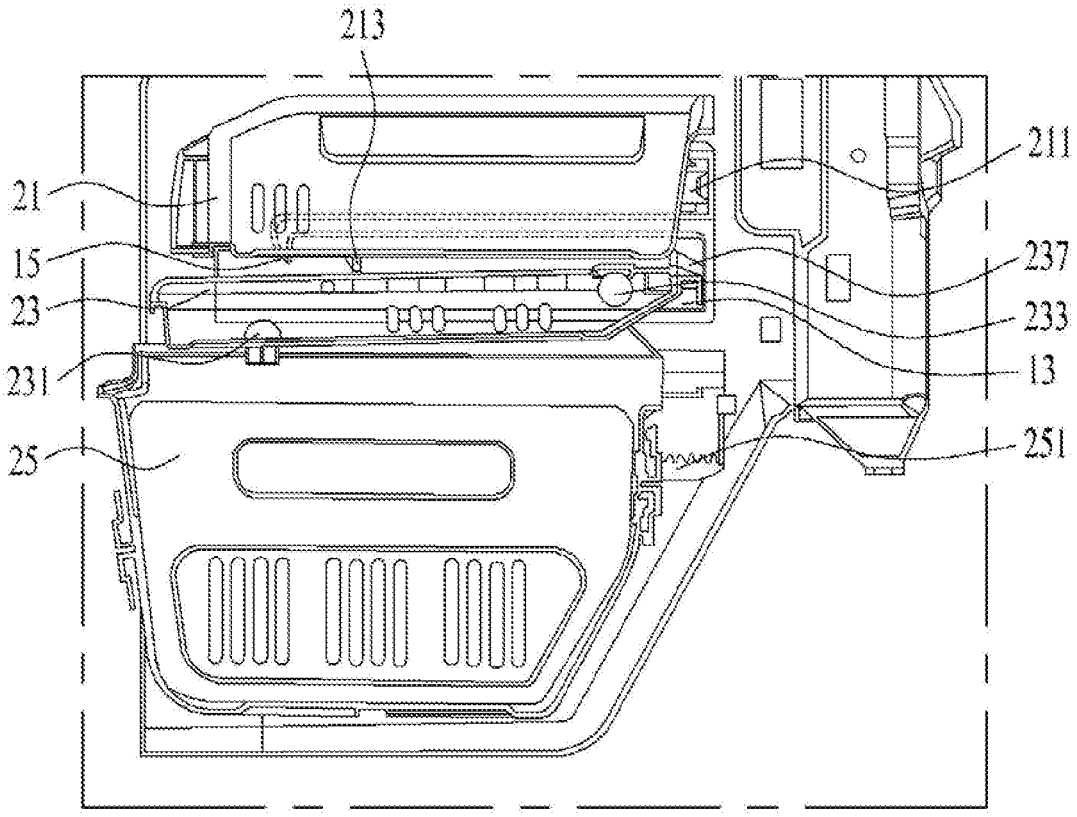
FIG. 6 is a sectional view of the refrigerator according to an embodiment.

As illustrated in FIG. 2, the lower drawer 25 may be connected to second rails 251, and move in forward and rearward directions (see FIG. 6). The door 2 may also be installed at a front side of the lower drawer 25 and, as such, the lower drawer 25 may move together with the door 2.

The lower drawer 25 may be defined therein with a space to store articles. The space of the lower drawer 25 may be larger than spaces of the intermediate drawer 23 and upper drawer 21. Accordingly, it may be possible to store a larger amount of articles in the lower drawer 25 and the center of gravity of the storage compartment 11 may be lowered, achieving an enhancement in stability.

The upper drawer 21 may be provided above the lower drawer 25. The upper drawer 21 may be connected to the cabinet 1 by first rails 211, to be movable in forward and rearward directions. The upper drawer 21 may have a smaller capacity than the lower drawer 25.

The intermediate drawer 23 may be provided between the upper drawer 21 and the lower drawer 25. The intermediate drawer 23 may be provided with rollers 231 at opposite lateral ends thereof. The rollers 231 may be guided by guide rails 253 provided at the lower drawers 25.

The guide rails 253 may be provided at upper surfaces of opposite lateral walls of the lower drawer 25, respectively. Accordingly, the intermediate drawer 23 may be movable in forward and rearward directions along upper surfaces of the lower drawer 25. The intermediate drawer 23 may be a smaller capacity than the upper drawer 21. In this regard, the intermediate drawer 23 may be suitable to store food articles having a wide area while being thin, for example, pizza. In addition, the intermediate drawer 23 may further include auxiliary rollers 233 provided at opposite lateral ends of the intermediate drawer 23 while being provided rearward of the rollers 231.

The auxiliary rollers 233 may be guided by auxiliary guide rails 13 provided at the inside of the cabinet 1 (see FIG. 6). Accordingly, it may be possible to distribute the weight of the intermediate drawer 23 not only to the lower drawer 25, but also to the cabinet 1.

The lower drawer 25 may include first stoppers 255 protruding upward from respective guide rails 253. The first stoppers 255 may be provided at front portions of the guide rails 253 (portions toward the door 2), respectively. The first stoppers 255 may have a height smaller than the radius of the rollers 231.

Figure 3:
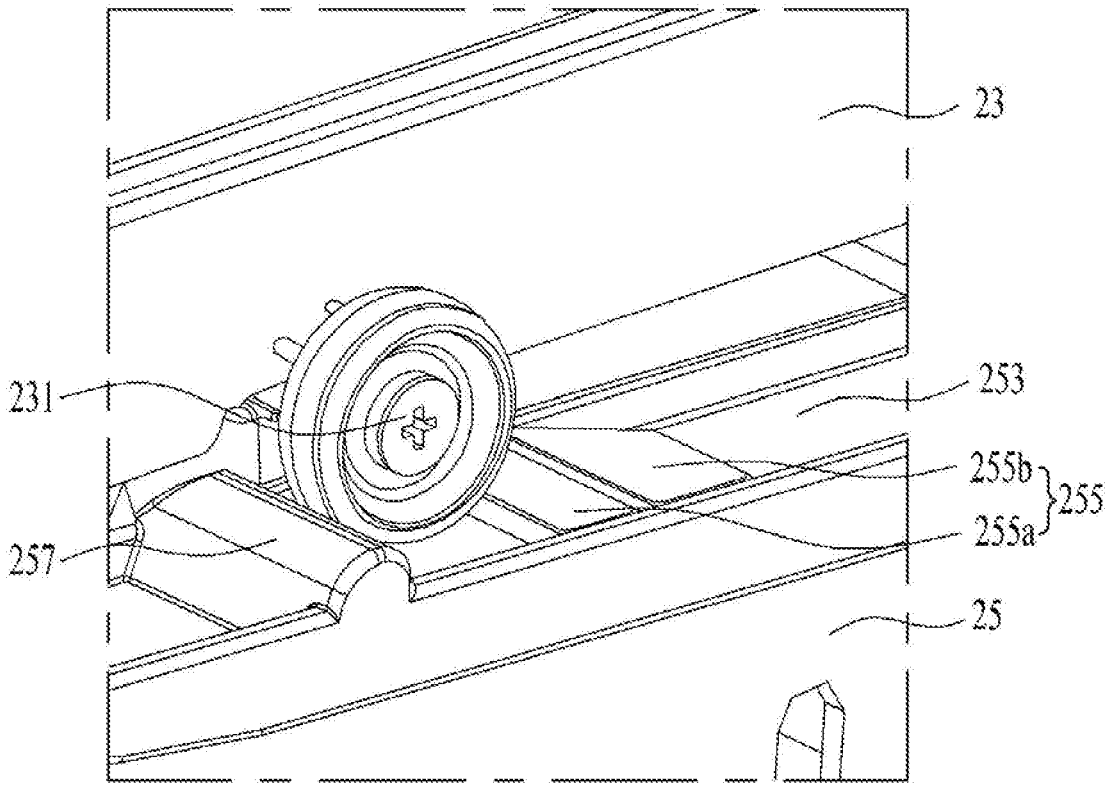
FIG. 3 is an enlarged front perspective view corresponding to FIG. 2.

Referring to FIG. 3, each first stopper 255 may include a first incline (or a ramp) 255*a* inclined forward, and a second incline (or a ramp) 255*b* inclined rearward. The second incline 255*b* may have a smaller angle of inclination than the first incline 255*a*. Accordingly, when the door 2 is opened, the first stoppers 255 may interfere with rearward movement of the rollers 231 and, as such, the intermediate drawer 23 may be moved forward together with the lower drawer 25.

Each first incline 255*a* may interfere with rearward movement of the corresponding roller 231. When a force greater than a predetermined force is applied to the roller 231, the roller 231 may cross the first incline 255*a*, as the height of the first stopper 255 may be smaller than the radius of the roller 231. The roller 231 crossing the first stopper 255 may then be guided rearward by the corresponding guide rail 253.

The lower drawer 25 may further include third stoppers 259, each protruding upward from a rear end of corresponding guide rails 253 (see FIG. 2). Accordingly, when the rollers 231 are guided rearwards along the guide rails 253, rearward separation from the guide rails may be prevented because excessive rearward movement of the rollers 231 may be prevented by the third stoppers 259.

When the door 2 is closed, the lower drawer 25 may be moved rearward, and the intermediate drawer 23 may be moved forward with respect to the lower drawer 25. The rollers 231 may ride on the second inclines 255*b*, and then cross the first stoppers 255, respectively.

The lower drawer 25 may further include second stoppers 257 protruding upward from respective guide rails 253 while being positioned forward of the respective first stoppers 255. Each roller 231 may be provided between a corresponding first stopper 255 and a corresponding second stoppers 257. Accordingly, it may be possible to prevent noise caused by striking the intermediate drawer 23 against the door 2 or lower drawer 25 when the door 2 is closed.

Figure 4:
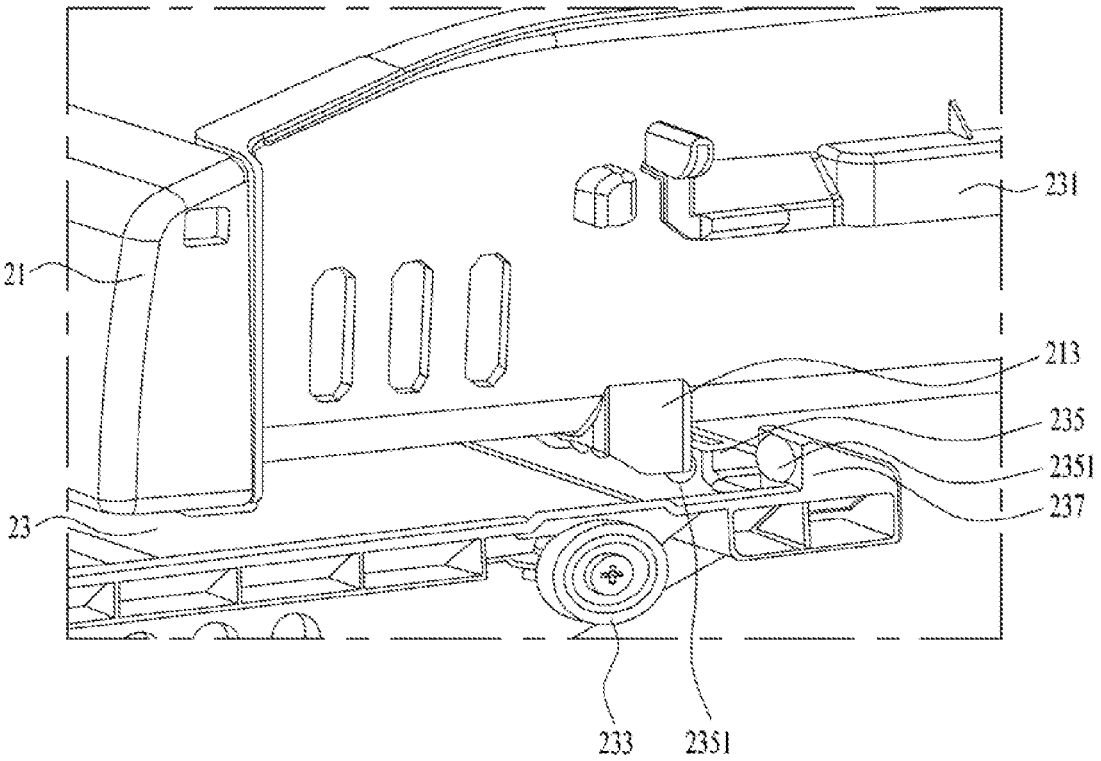
FIG. 4 is an enlarged rear perspective view corresponding to FIG. 2.

A configuration causing the intermediate drawer 23 to strike the upper drawer 21 during movement thereof, thereby allowing the user to view the upper drawer 21 while standing, will be described with reference to FIGS. 2 and 4. The intermediate drawer 23 may include actuators 235 for moving the upper drawer 21 forwards. Each actuator 235 protrudes upward from the intermediate drawer 23. In addition, the upper drawer 21 may include driven members (or protrusions or tabs) 213 protruding downward from the upper drawer 21. Each actuator 235 may strike a corresponding one of the driven members 213, to move the upper drawer 21 forward.

Figure 5:
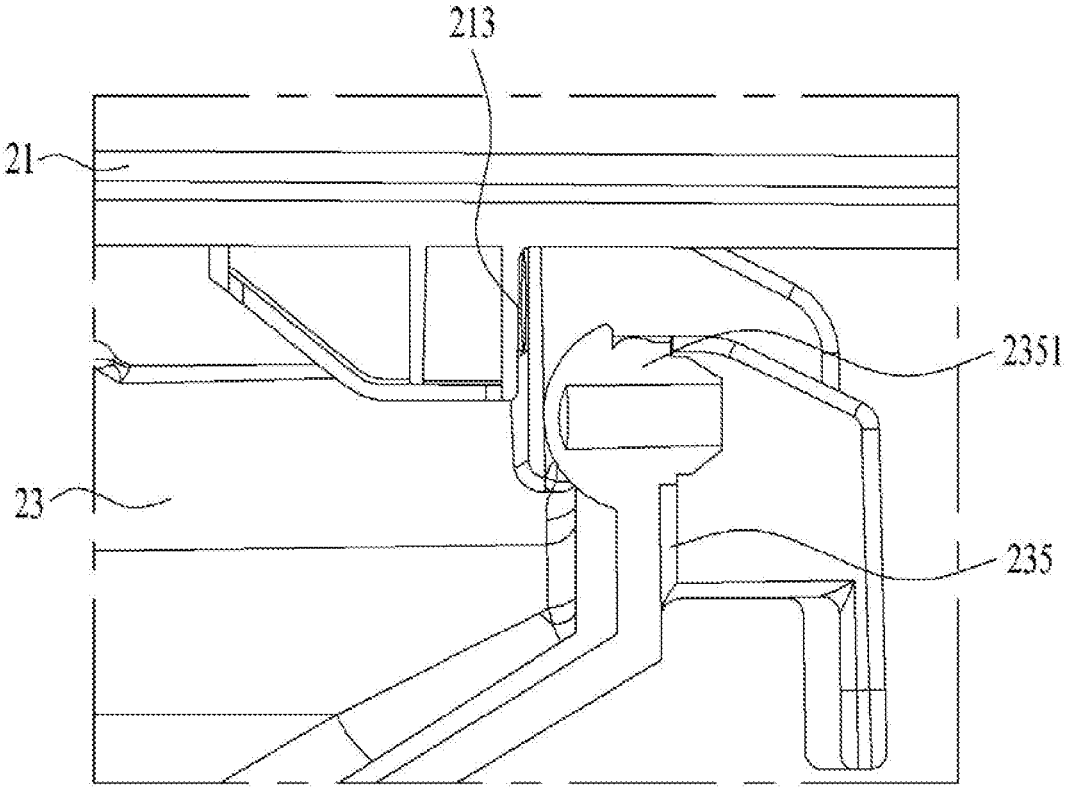
FIG. 5 is a sectional view of a driven member and an actuator.

Each actuator 235 may be provided rearwards of the corresponding driven member 213. In particular, each actuator 235 may be provided at a rear end of the intermediate drawer 23. As illustrated in FIG. 5, each actuator 235 may include a damping member (or a damper) 2351 to prevent generation of noise when the actuator 235 strikes the corresponding driven member 213. The damping member 2351 may include an elastic member made of a rubber material.

A configuration for preventing the intermediate drawer 23 from moving forwards by a predetermined distance or more will be described with reference to FIG. 6. The intermediate drawer 13 may further include fourth stoppers 237 protruding from the rear end thereof (see FIG. 2 or 4). The fourth stoppers 237 may be engageable with fifth stoppers 15 provided at the cabinet 1, respectively, to prevent the intermediate drawer 23 from further moving forwards. Accordingly, the intermediate drawer 23 may be movable forwards by a predetermined distance, together with the lower drawer 25, and the lower drawer 25 may then be movable forward alone.

Figure 7:
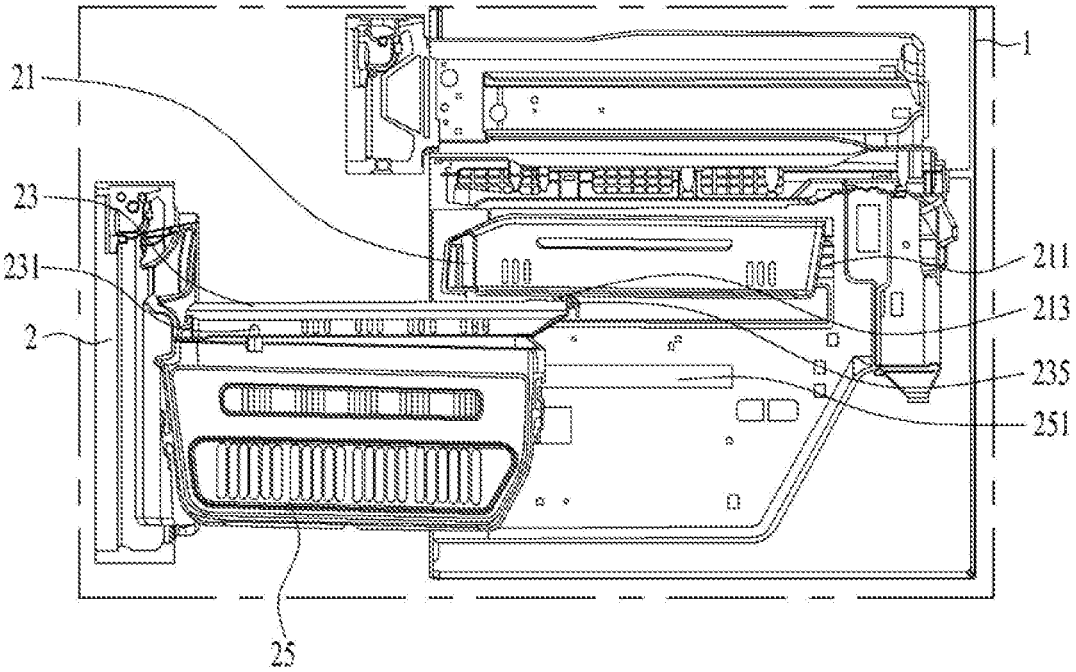
FIG. 7 is a view illustrating a state in which a lower drawer and an intermediate drawer are simultaneously moved when a door is opened.
Figure 8:
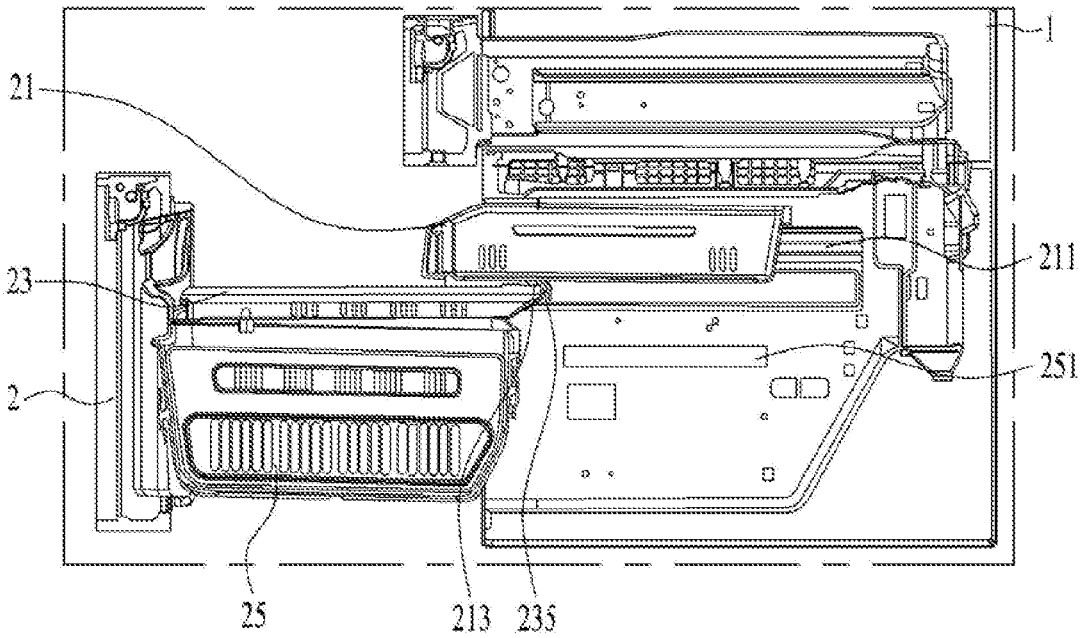
FIG. 8 is a view illustrating a state in which the intermediate drawer moves an upper drawer forward by striking a rear end of the upper drawer when the door is opened.
Figure 9:
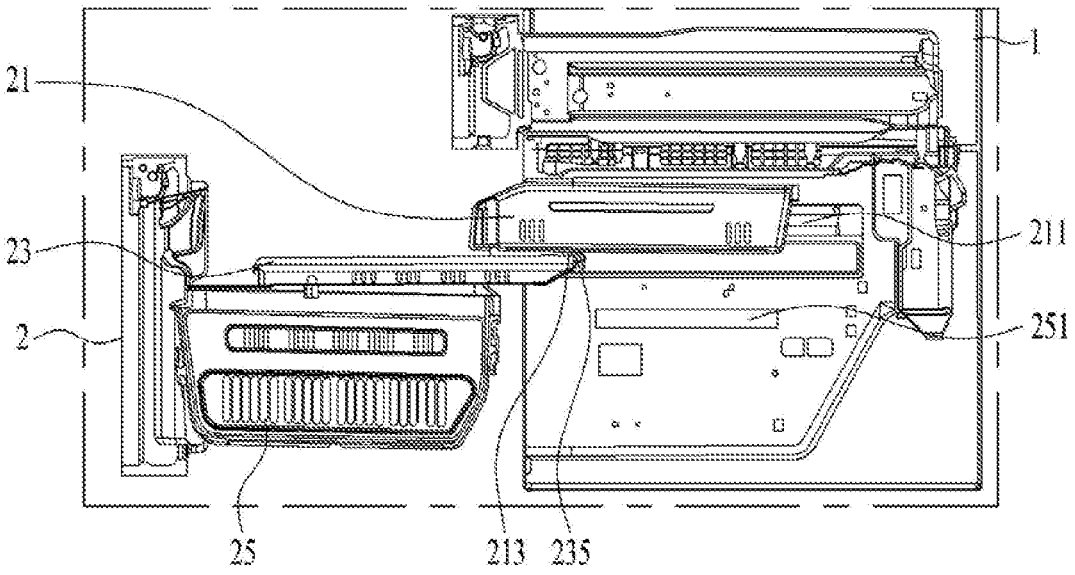
FIG. 9 is a view illustrating a state in which the lower drawer is opened forward to a maximal opening degree under the condition that movement of the intermediate drawer is stopped, when the door is opened.

Operations of the drawers included in the refrigerator 100 according to the illustrated embodiment will be described with reference to FIGS. 7, 8, and 9. When the user opens the door 2, the lower drawer 25 connected to the door 2 may be moved forward, together with the door 2. The rollers 231 may be prevented from moving rearward by the first stoppers 255 provided at the guide rails 253 and, as such, the intermediate drawer 23 may be moved forward by a predetermined distance, together with the lower drawer 25. In the illustrated embodiment, the distance that the lower drawer 25 and intermediate drawer 23 move simultaneously may be up to about 219 mm (see FIG. 7).

Thereafter, the actuators 235 provided at the rear end of the intermediate drawer 23 may strike rear ends of the driven members 213 provided at the upper drawer 21, thereby pushing the driven members 213 forward. The upper drawer 21 may be moved forward by a predetermined distance. In the illustrated embodiment, the distance that the intermediate drawer 23 and upper drawer 21 move simultaneously may be up to about 269 mm (see FIG. 8). As a result, the user may view the upper drawer 21 while standing and, as such, may recognize the upper drawer 21. Generation of noise may be prevented because the damping members 2351 may be provided at respective actuators 235.

Subsequently, the fourth stoppers 237 provided at the intermediate drawer 23 may be engaged with respective fifth stoppers 15 and, as such, the intermediate drawer 23 may be prevented from moving forward. In this case, the lower drawer 25 may be continuously moved in the forward direction, together with the door 2. In the illustrated embodiment, the movement distance of the lower drawer 25 may be up to about 431 mm (see FIG. 9).

The rollers 231 may be guided toward rear sides of the guide rails 253 after crossing the first stoppers 255, respectively. In more detail, the lower drawer 25 including the guide rails 253 may move forward when the intermediate drawer 23 including the rollers 231 may be stopped and, as such, the rollers 231 are positioned at respective rear sides of the guide rails 253. Accordingly, when the door 2 is completely opened, opening degrees of the lower drawer 25, intermediate drawer 23 and upper drawer 21 may be gradually reduced in the order of the lower drawer 25, intermediate drawer 23 and upper drawer 21 such that the lower drawer 25 has a maximal opening degree. Thus, the user may simultaneously view all articles stored in the drawers.

When the user closes door 2, the lower drawer 25 may be moved rearward and, as such, the rollers 231 of the intermediate drawer 23 may ride on respective second inclines 255*b*, and then may cross respective first stoppers 255. Each roller 231 may be subsequently moved in the rearward direction when the roller 231 is engaged between the corresponding second stopper 257 and the corresponding first stopper 255. Accordingly, the lower drawer 25 and intermediate drawer 23 may be simultaneously moved in the rearward direction. The upper drawer 21 may be moved rearward by a rear surface of the door 2 and, as such, may be returned to a state thereof established when the door 2 is closed.

The embodiments provide a refrigerator capable of allowing the user to recognize an upper drawer upon opening a door. The embodiments further provide a refrigerator in which, when the user opens a door, an upper drawer may be moved forward as an intermediate drawer arranged beneath the upper drawer strikes the upper drawer, which may allow the user to easily withdraw the upper drawer.

A refrigerator may include a cabinet provided with a storage compartment, a door moving forward and backward for opening/closing the storage compartment, a lower drawer provided at or in the cabinet, and connected to the door, an upper drawer provided at or in the cabinet, and provided over the lower drawer, and an intermediate drawer provided between the upper drawer and the lower drawer, wherein the lower drawer includes a first stopper, and the intermediate drawer includes an actuator movable forward by the first stopper of the lower drawer when the door is opened, the actuator moves the upper drawer.

The intermediate drawer may further include rollers provided at opposite lateral ends of the intermediate drawer, respectively. The lower drawer may further include guide rails for guiding the rollers, respectively, to enable the intermediate drawer to move forward and rearward.

The first stopper may protrude upward from each of the guide rails. The first stopper may include a first incline inclined forward, and a second incline inclined rearward, the second incline having a smaller angle of inclination than the first incline.

The lower drawer may further include a second stopper provided in front of the first stopper while protruding upward from the guide rail. The lower drawer may further include a third stopper protruding upward at a rear end of the guide rail.

The upper drawer may include a driven member protruding downward from the upper drawer. The actuator may protrude upward from the intermediate drawer. The actuator may move the upper drawer by striking the driven member.

The intermediate drawer may further include a damping member provided at the actuator, to prevent generation of noise. The intermediate drawer may further include a fourth stopper protruding at a rear end of the intermediate drawer, to restrict forward movement of the intermediate drawer to a predetermined distance.

As apparent from the above description, embodiments provide a refrigerator capable of allowing the user to recognize an upper drawer upon opening a door. Embodiments also provide a refrigerator in which, when the user opens a door, an upper drawer may be moved forward as an intermediate drawer arranged beneath the upper drawer strikes the upper drawer, thereby allowing the user to easily withdraw the upper drawer.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a storage compartment;

a door configured to be moved forward and rearward to open and close the storage compartment;

a lower drawer provided in the cabinet and connected to the door, and including guide rails provided at upper surfaces of opposite lateral walls of the lower drawer, at least one first stopper protruding upward from the guide rails, and at least one second stopper provided forward of the at least one first stopper and protruding upward from the guide rails, and a third stopper protruding upward at a rear end of the guide rail;

an upper drawer provided in the cabinet and positioned over the lower drawer; and an intermediate drawer positioned between the upper drawer and the lower drawer, and having at least one actuator protruding upward, and rollers provided at opposite lateral sides of the intermediate drawer and guided by the guide rails, wherein when the door is opened, the at least one first stopper pulls the intermediate drawer in a forward direction and the at least one actuator pulls the upper drawer in a forward direction.

2. The refrigerator according to claim 1, wherein the first stopper includes:

a first ramp inclined forward; and a second ramp inclined rearward, wherein the second ramp has a smaller angle of inclination than the first ramp.

3. The refrigerator according to claim 1, wherein:

the upper drawer includes a driven member protruding downward from the upper drawer; and the actuator moves the upper drawer by striking the driven member.

4. The refrigerator according to claim 3, wherein the intermediate drawer further includes a damper provided at the actuator, to prevent generation of noise when striking the driven member.

5. A refrigerator comprising:

a cabinet having a storage compartment;

a door configured to be moved forward and rearward to open and close the storage compartment;

a lower drawer provided in the cabinet and connected to the door, and including at least one first stopper;

an upper drawer provided in the cabinet and positioned over the lower drawer; and an intermediate drawer positioned between the upper drawer and the lower drawer, and having at least one actuator protruding upward, wherein when the door is opened, the at least one first stopper pulls the intermediate drawer in a forward direction and the at least one actuator pulls the upper drawer in a forward direction, wherein the intermediate drawer further includes a fourth stopper protruding upward at a rear end of the intermediate drawer, to restrict forward movement of the intermediate drawer to a predetermined distance.

6. A refrigerator comprising:

a cabinet having a storage compartment;

a door configured to slide in a first direction and a second direction opposite the first direction to open and close the storage compartment;

a lower drawer provided in the cabinet and connected to the door, the lower drawer including:

a least one guide rail;

at least one first stopper protruding upward from the at least one guide rail;

at least one second stopper protruding upward from the at least one guide rail and positioned in front of the at least one first stopper in the first direction; and at least one third stopper protruding upward from the at least one guide rail and positioned behind the at least one first stopper in the first direction;

an upper drawer provided in the cabinet and positioned above the lower drawer, the upper drawer including at least one driven member protruding downward from the upper drawer; and an intermediate drawer provided in the cabinet and positioned between the lower drawer and the upper drawer, the intermediate drawer including:

at least one actuator protruding upward; and at least one roller configured to roll along the at least one guide rail.

7. The refrigerator according to claim 6, wherein when the door is pulled in the first direction, the at least one first stopper engages with the at least one roller to pull the intermediate drawer in the first direction, and the at least one actuator engages with the at least one driven protrusion to pull the upper drawer in the first direction.

8. The refrigerator according to claim 7, wherein the at least one first stopper includes a first ramp inclined in the first direction, and a second ramp inclined in the second direction, wherein the second ramp has a smaller angle of inclination than the first ramp.

9. The refrigerator according to claim 6, wherein the intermediate drawer further includes at least one auxiliary roller configured to engage with at least one auxiliary guide rail connected to an inside of the cabinet.

10. The refrigerator according to claim 6, wherein the intermediate drawer further includes at least one fourth stopper protruding upward at a rear end of the intermediate drawer and configured to engage with at least one fifth stopper attached to the cabinet to limit movement of the intermediate drawer in the first direction.

11. The refrigerator according to claim 6, wherein the intermediate drawer further includes a damper provided at the actuator, to prevent generation of noise when striking the driven protrusion.

* * * * *